US008833734B2

(12) United States Patent
Patel

(10) Patent No.: US 8,833,734 B2
(45) Date of Patent: Sep. 16, 2014

(54) LIVEWELL FILL VALVE

(75) Inventor: Anil B. Patel, La Crescenta, CA (US)

(73) Assignee: Pentair Flow Technologies, LLC, Delavan, WI (US)

( * ) Notice: Subject to any disclaimer, the term of this patent is extended or adjusted under 35 U.S.C. 154(b) by 251 days.

(21) Appl. No.: 12/836,292

(22) Filed: Jul. 14, 2010

(65) Prior Publication Data

US 2011/0024658 A1 Feb. 3, 2011

Related U.S. Application Data

(60) Provisional application No. 61/225,516, filed on Jul. 14, 2009.

(51) Int. Cl.
*F16K 31/00* (2006.01)
*B63B 35/26* (2006.01)

(52) U.S. Cl.
CPC ..... *B63B 35/26* (2013.01)
USPC ..... 251/345; 251/351; 251/352

(58) Field of Classification Search
USPC ..... 251/345, 351, 353, 339, 340, 349, 215, 251/273, 343, 344, 304, 366, 352; 43/54.1, 43/55, 57
See application file for complete search history.

(56) References Cited

U.S. PATENT DOCUMENTS 318,479 A * 5/1885 Kells ..... 222/519
3,964,510 A 6/1976 Roller
4,189,099 A 2/1980 Bruninga
4,261,131 A 4/1981 Poffenberger
4,275,522 A 6/1981 Glover
4,384,857 A 5/1983 Hoy, Jr.
4,473,967 A 10/1984 Poirot
4,589,441 A 5/1986 Campau
4,643,267 A 2/1987 Southern et al.
4,748,765 A 6/1988 Martin
4,821,445 A 4/1989 Bass
4,832,073 A 5/1989 Campau
4,865,776 A 9/1989 Campau
4,927,568 A 5/1990 Campau
4,932,348 A 6/1990 Nix et al.
4,945,672 A 8/1990 Raia
4,948,095 A 8/1990 Campau
4,951,355 A 8/1990 Pack
4,970,982 A 11/1990 Martin
5,010,836 A 4/1991 Riviezzo
D317,347 S 6/1991 Whitley, II
5,111,762 A 5/1992 Frangiamore
5,164,643 A 11/1992 Campau
5,165,358 A 11/1992 Fielder
5,181,540 A 1/1993 Campau
5,193,762 A 3/1993 Takeuchi
5,236,175 A 8/1993 Campau
(Continued)

*Primary Examiner* — John K Fristoe, Jr.
*Assistant Examiner* — Michael R Reid
(74) *Attorney, Agent, or Firm* — Greenberg Traurig, LLP

(57) ABSTRACT

Embodiments of the invention provide a fill valve for use in a livewell of a boat. The fill valve includes an intake and a valve housing coupled to the intake. The valve housing includes a rounded half-sphere shaped front wall coupled to a substantially flat back wall. The front wall includes one or more inlet openings in fluid communication with the intake. The fill valve also includes a valve switch positioned in the valve housing to switch between a first position allowing fluid communication between the inlet openings and the intake and a second position providing a substantially liquid-tight seal between the inlet openings and the intake.

17 Claims, 6 Drawing Sheets

(56) References Cited

U.S. PATENT DOCUMENTS

| | | | |
|---|---|---|---|
| 5,279,246 | A | 1/1994 | Fielder |
| 5,294,840 | A | 3/1994 | Vellenga et al. |
| 5,390,439 | A | 2/1995 | Kilian, III et al. |
| 5,582,777 | A | 12/1996 | Vento |
| 5,632,220 | A | 5/1997 | Vento |
| 5,729,928 | A | 3/1998 | Anderson |
| 5,876,639 | A | 3/1999 | Campau |
| 5,927,240 | A | 7/1999 | Maxon |
| 5,988,600 | A | 11/1999 | Vento |
| 6,003,840 | A | 12/1999 | Campau |
| 6,038,993 | A | 3/2000 | Vento |
| 6,065,498 | A | 5/2000 | Campau |
| 6,089,933 | A | 7/2000 | Cotton |
| 6,192,820 | B1 | 2/2001 | Anderson et al. |
| 6,257,626 | B1 | 7/2001 | Campau |
| 6,311,727 | B1 | 11/2001 | Campau |
| 6,394,423 | B1 | 5/2002 | Vento |
| 6,443,496 | B2 | 9/2002 | Campau |
| D471,249 | S | 3/2003 | Walters |
| 6,532,889 | B1 | 3/2003 | Goad et al. |
| 6,655,663 | B2 | 12/2003 | Vento |
| 6,689,262 | B2 | 2/2004 | Senkiw |
| 6,810,617 | B1 | 11/2004 | Burroughs et al. |
| 6,874,442 | B1 | 4/2005 | McDonough |
| 6,892,664 | B2 | 5/2005 | Stinson |
| 7,162,831 | B1 | 1/2007 | Morton et al. |
| D540,418 | S | 4/2007 | Walters |
| D544,943 | S | 6/2007 | Walters |
| D545,938 | S | 7/2007 | Walters |
| 7,263,945 | B2 | 9/2007 | Little |
| 7,281,488 | B1 | 10/2007 | Sanders |
| 7,343,261 | B1 | 3/2008 | Kell |
| 7,396,441 | B2 | 7/2008 | Senkiw |
| 2006/0266971 | A1* | 11/2006 | Tonelli ..... 251/216 |

* cited by examiner

LIVEWELL FILL VALVE

RELATED APPLICATIONS

This application claims priority under 35 U.S.C. §119 to U.S. Provisional Patent Application No. 61/225,516 filed on Jul. 14, 2009, the entire contents of which is incorporated herein by reference.

BACKGROUND

Livewells and baitwells are commonly found in boats to keep caught fish and bait alive. A livewell is generally a water tank that includes a fill valve, a pump, and a drain. The fill valve is positioned inside the livewell and receives water from the pump to fill the livewell. The pump can either pump water from a body of water to fill the livewell or pump water from the livewell for circulation and aeration.

Conventional fill valves have nozzles or knobs that extend out from the inside wall of the livewell and are often positioned above the desired fill line of the livewell. However, when a boat is in motion, water in the livewell, as well as the fish in the livewell, move around and hit the fill valve. Hitting the edges of the nozzle or knobs can be fatal to the fish, making the livewell much less effective.

SUMMARY

Embodiments of the invention provide a fill valve for use in a livewell of a boat. The fill valve includes an intake and a valve housing coupled to the intake. The valve housing includes a rounded half-sphere shaped front wall coupled to a substantially flat back wall. The front wall includes one or more inlet openings in fluid communication with the intake. The fill valve also includes a valve switch positioned in the valve housing to switch between a first position allowing fluid communication between the inlet openings and the intake and a second position providing a substantially liquid-tight seal between the inlet openings and the intake.

DETAILED DESCRIPTION

Figure 1:
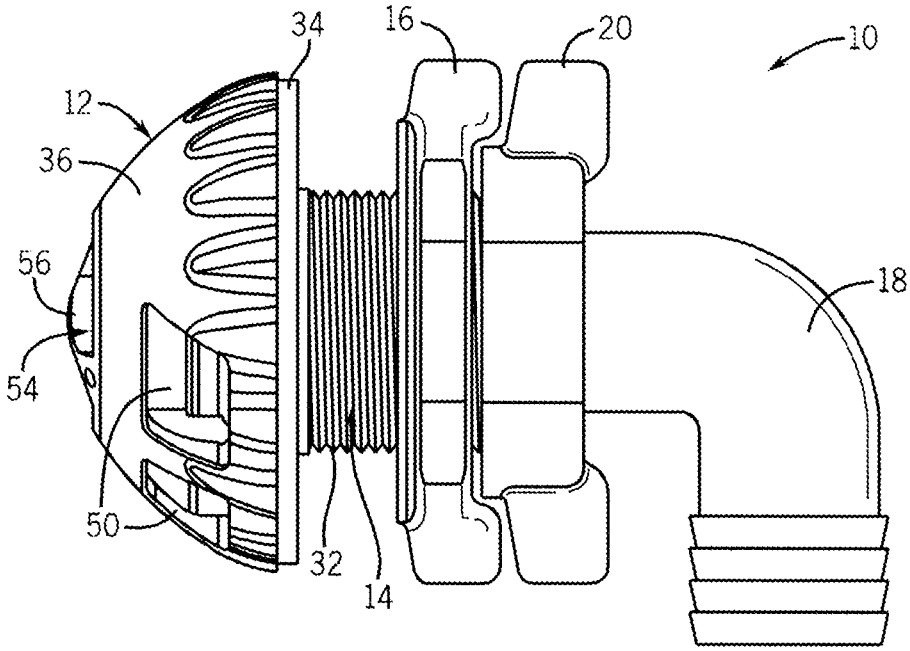
FIG. 1 is a side view of a livewell fill valve according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a livewell fill valve 10 according to one embodiment of the invention. The fill valve 10 can include a valve housing 12, an intake 14, a mounting nut 16, an adapter 18, and an adapter nut 20. As shown in FIG. 2A, the fill valve 10 can be used to control water flow into a livewell or baitwell 22 on a boat or marine craft 24 from a water source, such as a lake or ocean. As also shown in FIG. 2A, a pump 26 can be in fluid communication with the water source and can be coupled to the fill valve 10 via a hose 28 in order to pump water from the water source into the livewell 22 through the fill valve 10. In some embodiments, the fill valve 10 can be used in livewells 22 having a volume ranging from about 100 gallons to about 160 gallons.

Figure 3:
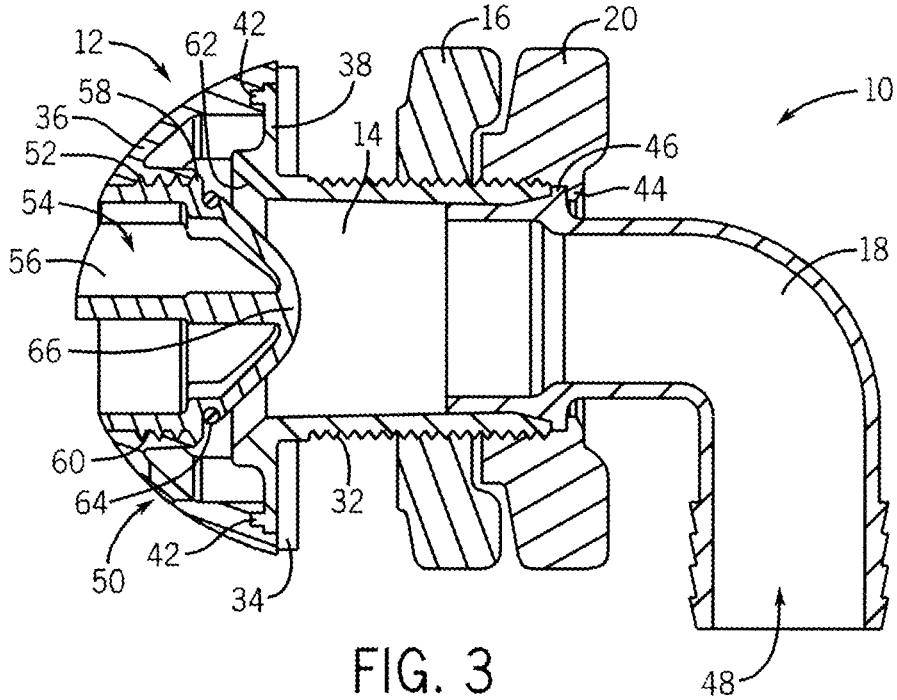
FIG. 3 is a cross-sectional side view of the livewell fill valve of FIG. 1.
Figure 2B:
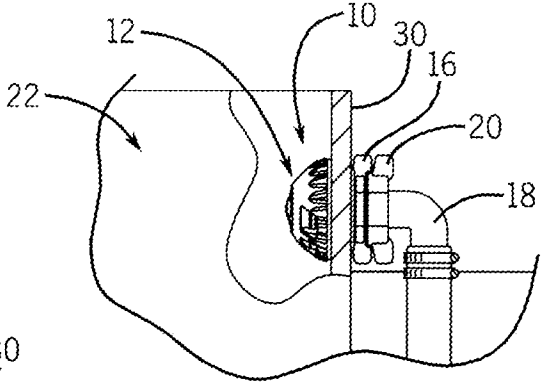
FIG. 2 is a side view of a livewell fill valve, according to one embodiment of the invention, coupled to a livewell on a boat.
Figure 2A:
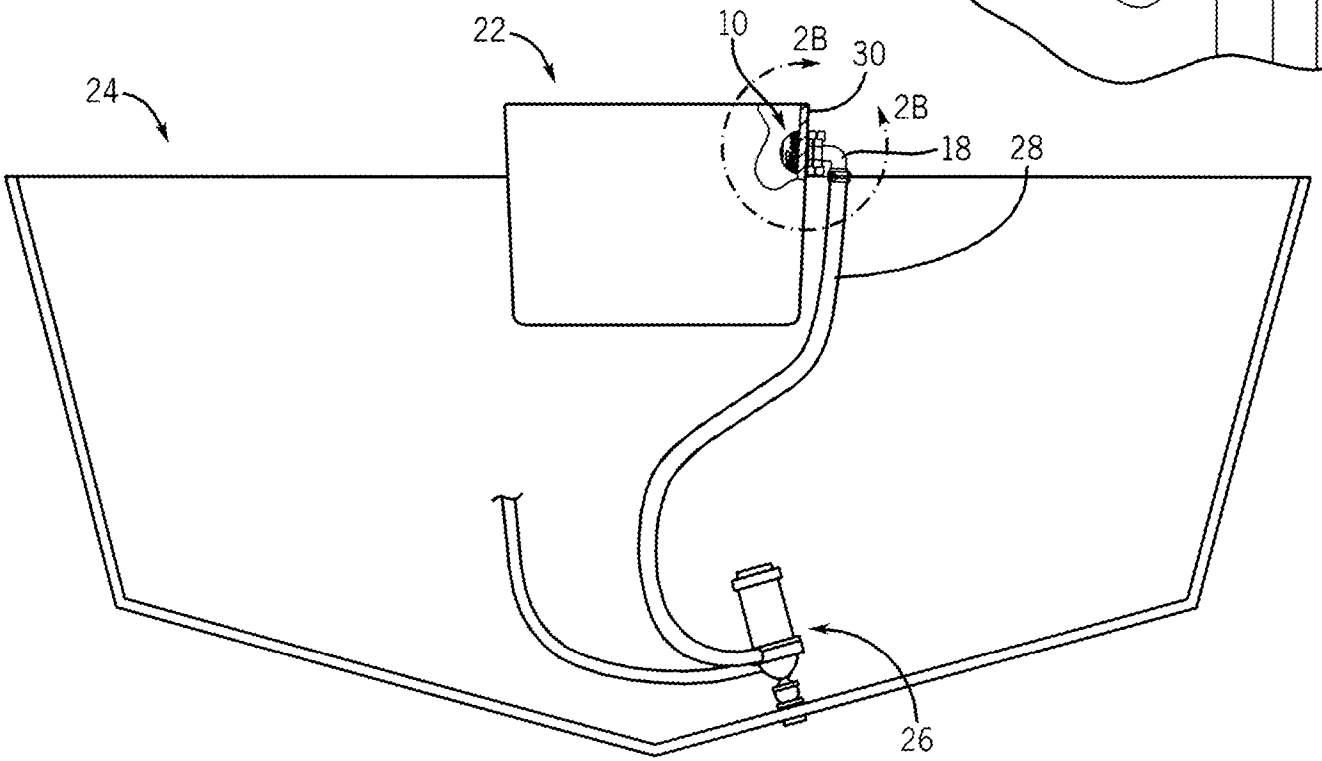
Figure 4:
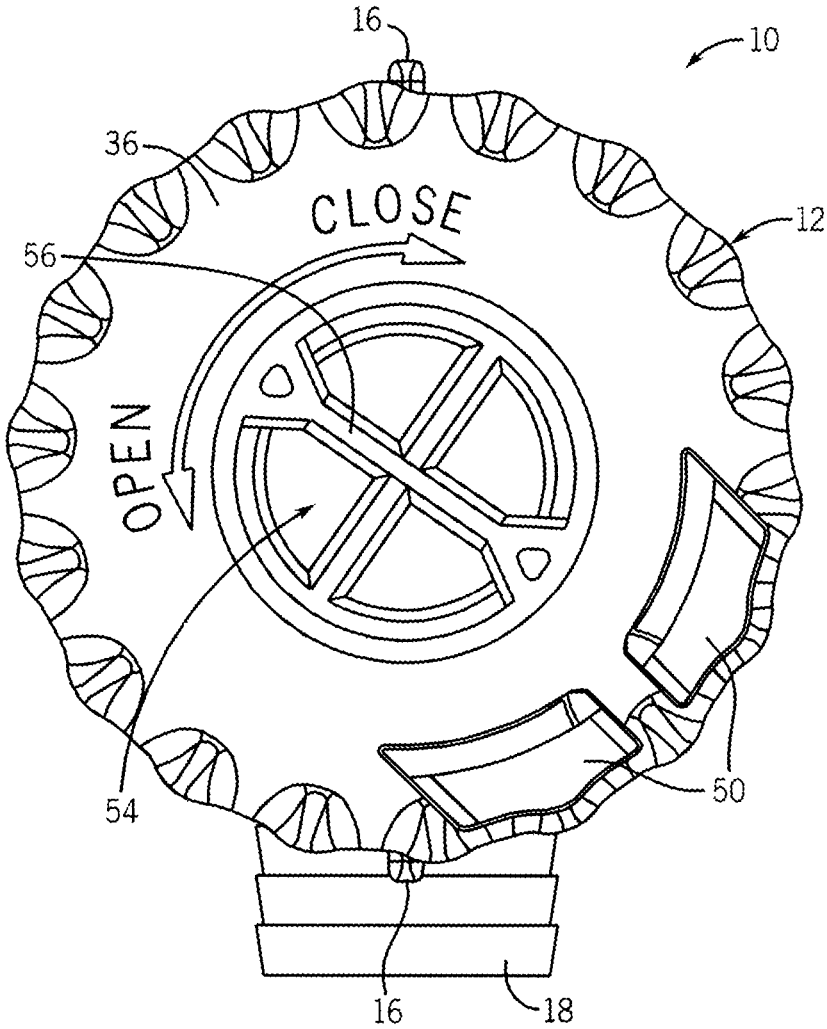
FIG. 4 is a front view of the livewell fill valve of FIG. 1.
Figure 5:
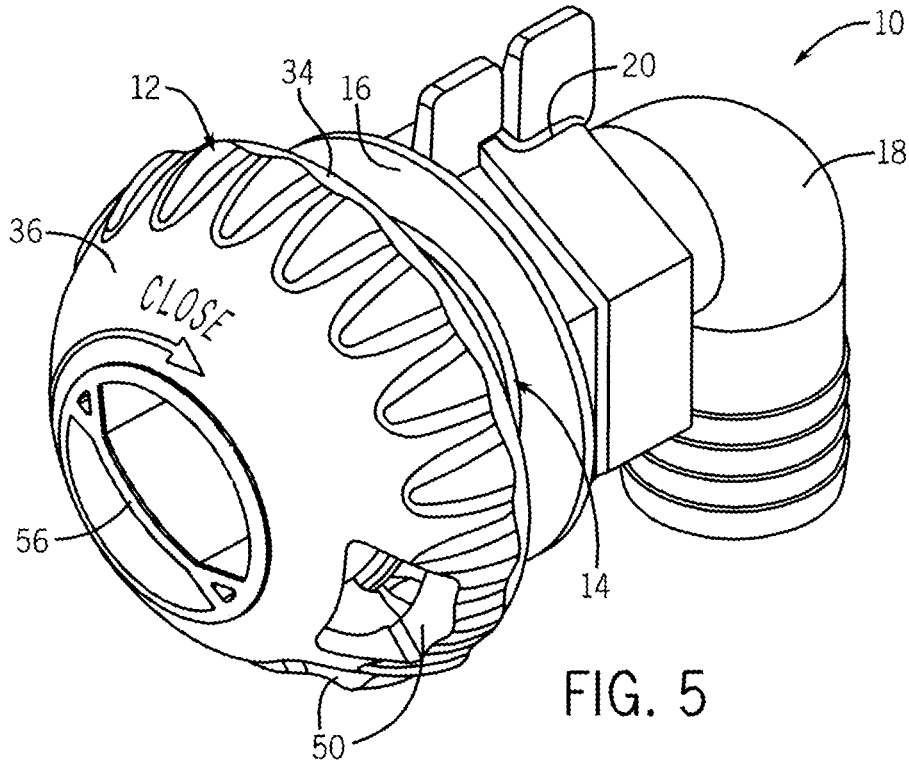
FIG. 5 is a front perspective view of the livewell fill valve of FIG. 1.

The valve housing 12 can be positioned against the inside of a wall 30 of the livewell 22, as shown in FIGS. 2A and 2B, and can be secured to the wall 30 via the mounting nut 16. More specifically, the intake 14 can be positioned through the livewell wall 30 and can have a threaded portion 32, as shown in FIGS. 1 and 3. Also, the mounting nut 16 can be rotatable about the threaded portion 32. The fill valve 10 can be fixed in place so that the valve housing 12 is flat against the inside of the wall 30 by tightening the mounting nut 16 around the threaded portion 32 against the outside of the livewell wall 30. As shown in FIGS. 1 and 3, an o-ring seal 34 can be positioned between the inside of the wall 30 and the valve housing 12 for a water-tight seal. The threaded portion 32 and the mounting nut 16 can allow the fill valve 10 to be adaptable to livewells 22 with different wall thicknesses. In one embodiment, the mounting nut 16 can be tightened using a tool, such as a wrench.

In some embodiments, the valve housing 12 can include a front wall 36 and a back wall 38, as shown in FIG. 3. The back wall 38 can be substantially flat so that it can fit against the inside of the livewell wall 30. The front wall 36 can include a rounded low-profile design, such as a substantially semi-spherical or half-sphere shape, that can be rounded toward the wall 30 of the livewell 22. More specifically, the front wall 36 can include a generally half-sphere shape extending from the back wall 38, as shown in FIGS. 1, 3, 5, and 6. The front wall 36 can be substantially rounded so that there are no extensions to pierce or harm fish that happen to contact or bump against the fill valve 10. Rather, fish can bounce off unharmed just as they bounce off the livewell wall 30.

Figure 7:
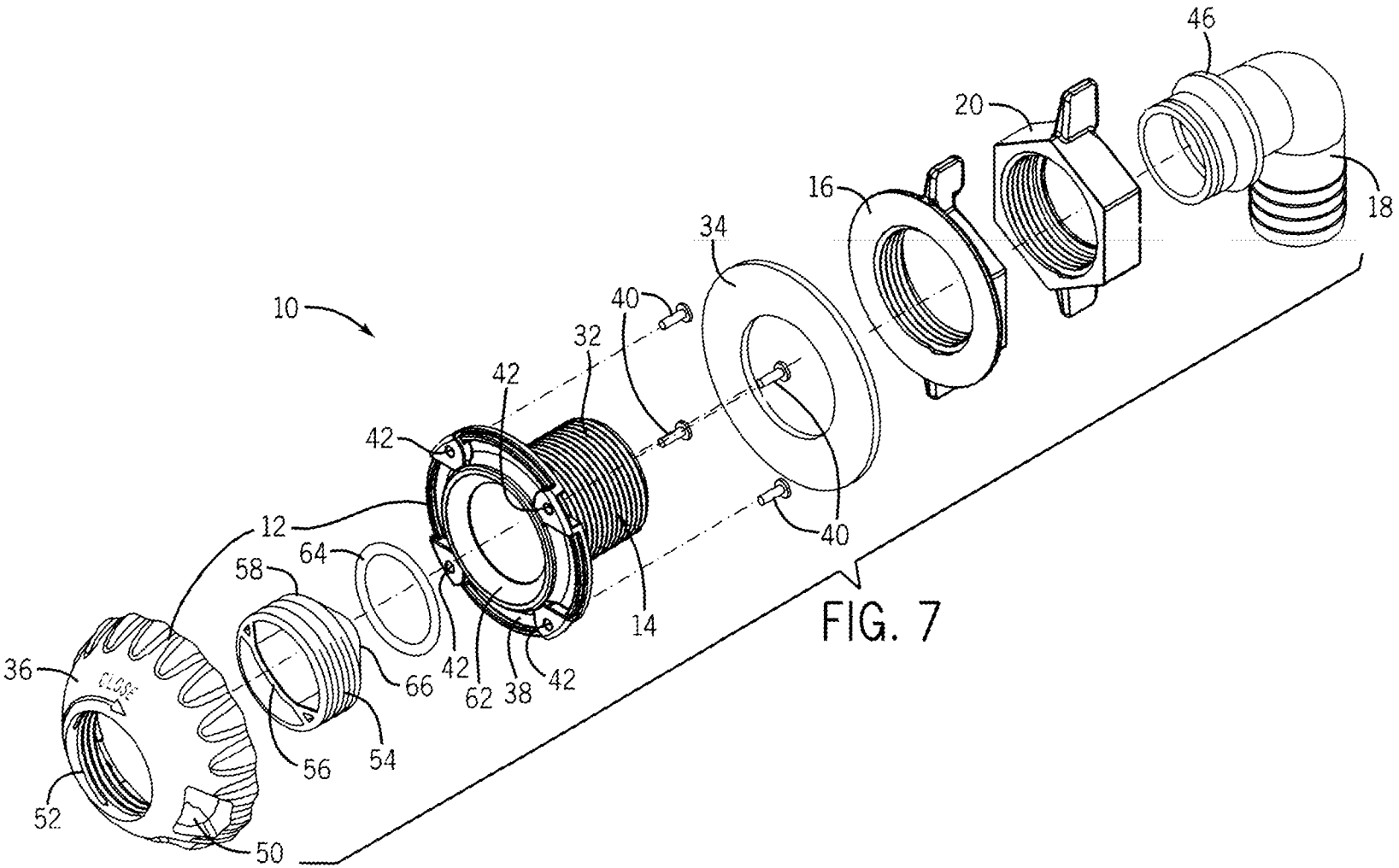
FIG. 7 is an exploded perspective view of the livewell fill valve of FIG. 1.

In some embodiments, the back wall 38 and the intake 14 can be constructed of a single integral part, as shown in FIGS. 3 and 7. In other embodiments, the back wall 38 and the intake 14 can be coupled together via press-fitting, fasteners, etc. The front wall 36 can be coupled to the back wall 38 via fasteners (e.g., screws 40) through mounting holes 42, as shown in FIGS. 3 and 7. In some embodiments, the o-ring seal can have a diameter spanning from the intake 14 to outer edges of the back wall 38 in order to help prevent the screws 40 from contacting water inside the livewell 22. In addition, in some embodiments, the intake 14 and the valve housing 12 can be constructed of Nylon or similar materials and the screws 40 can be constructed of stainless steel.

Figure 6:
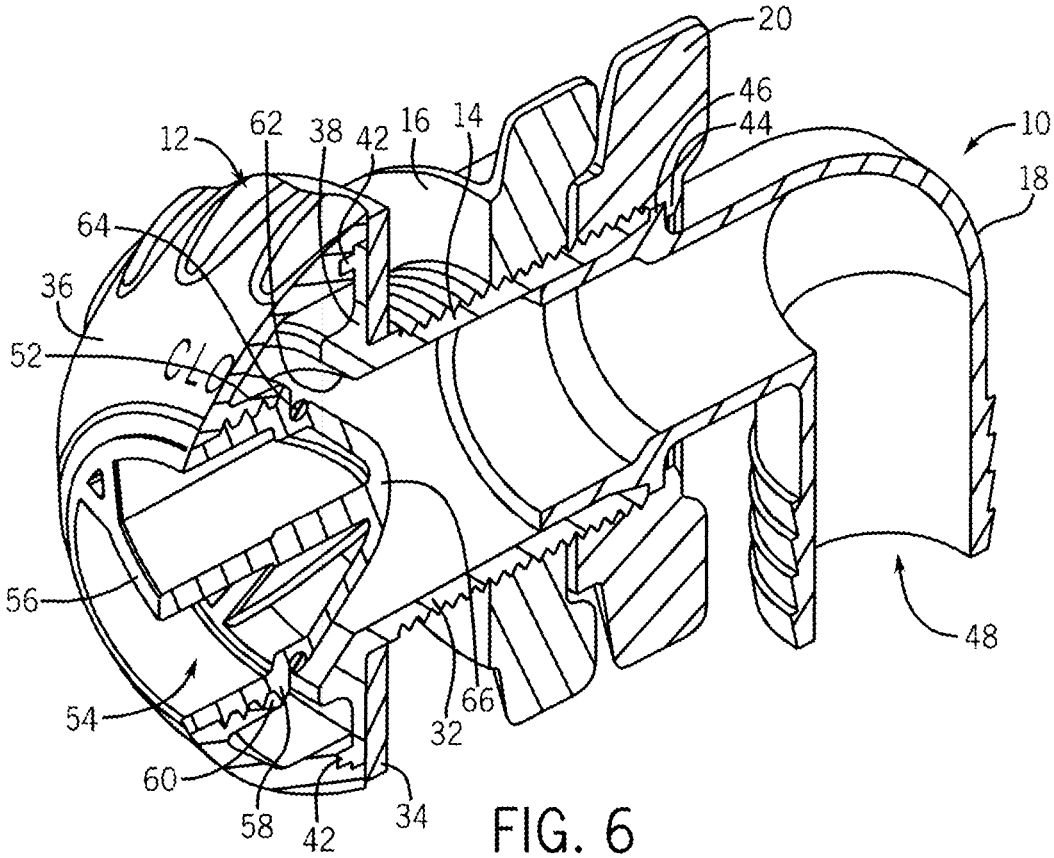
FIG. 6 is a front cross-sectional perspective view of the livewell fill valve of FIG. 1.

In some embodiments, as shown in FIGS. 1 and 2B, the adapter 18 can be removably coupled to the intake 14 after the intake 14 is positioned through the livewell wall 30. The adapter 18 can be press-fit into the intake 14 and the adapter nut 20 can be tightened onto the threaded portion 32 to secure the adapter 18 to the intake 14. The adapter nut 20 can be tightened until it reaches the mounting nut 16 and/or until an end flange 44 of the adapter nut 20 reaches an end flange 46 of the adapter 18, as shown in FIGS. 3 and 6. In some embodiments, the adapter 18 and the intake 14 can be coupled together by threaded fittings, fasteners, etc.

Figure 8:
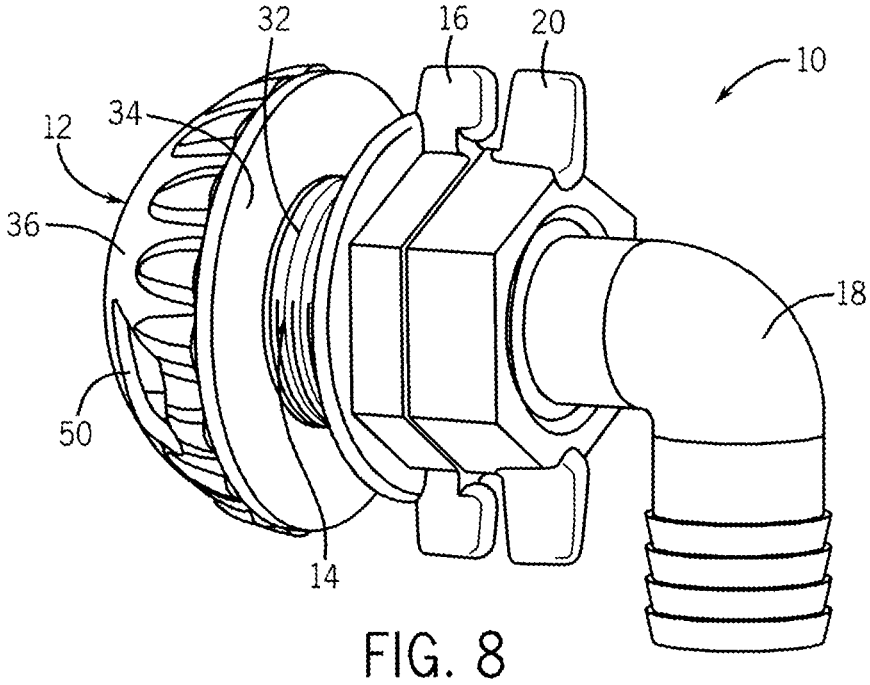
FIG. 8 is a back perspective view of the livewell fill valve of FIG. 1 including an adapter according to one embodiment of the invention.
Figure 9:
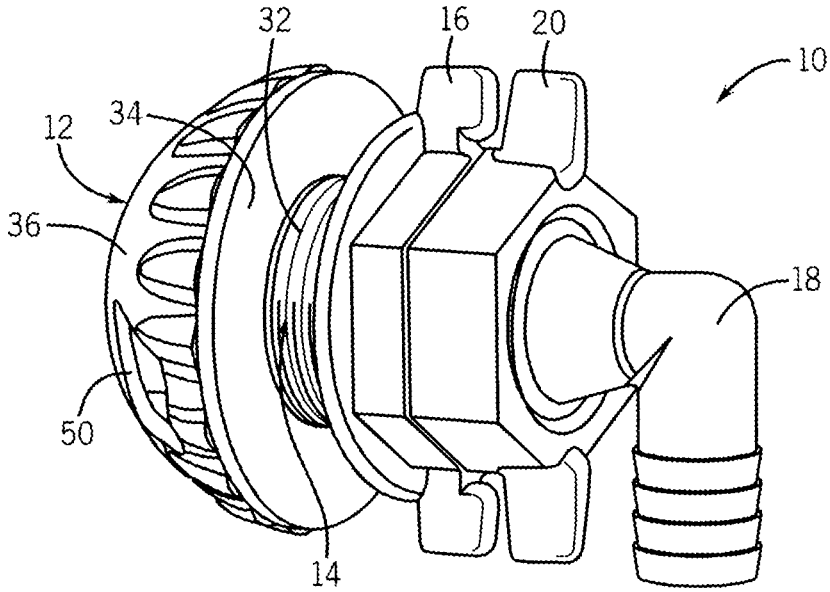
FIG. 9 is a back perspective view of the livewell fill valve of FIG. 1 including an adapter according to another embodiment of the invention.

In some embodiments, the adapter 18 can include an approximately 90-degree bend (e.g., similar to an elbow connector) in order to help couple the intake 14 to the hose 28. Alternatively, the adapter 18 can have different shapes, such as those shown in FIG. 8 or FIG. 9, to adapt to different hose fittings of the hose 28 connected to the pump 26. More specifically, different adapters 18 can be interchangeable and can have different diameters at an opening 48 (as shown in FIG. 3) in order to adapt the fill valve 10 to hoses 28 of different sizes. In some embodiments, the openings 48 can range from about 0.75 inches to about 1.125 inches. Also, the adapter 18 can be press-fit into the intake 14 (or the intake 14 press-fit can be into the adapter 18, in some embodiments) at different orientations before being secured by the adapter nut 20 in order to accommodate a hose 28 supplied from a different location. In one embodiment, the adapter nut 20 can be tightened using a tool, such as a wrench.

In some embodiments, as shown in FIGS. 1 and 3-7, the valve housing 12 can include at least one inlet opening 50 and a threaded cavity 52. For example, as shown in FIGS. 3 and 6, the front wall 36 can include two inlet openings 50 and the threaded cavity 52. The threaded cavity 52 can house a threaded valve switch 54 accessible through the front wall 36 (i.e., from inside the livewell 22). The valve switch 54 can be rotated within the threaded cavity 52 using an adjustment knob 56 in a first direction until an extension 58 of the valve switch 54 contacts a edge portion 60 of the threaded cavity 52 (indicating a fully-open position) or in a second direction until the extension 58 contacts a valve seat 62 of the intake 14 (indicating a fully-closed position). In the fully-closed position, the valve switch 54 can substantially prevent water flow between the intake 14 and the inlet openings 50. An o-ring 64 positioned around the valve switch 54 near the extension 58 can ensure a water-tight seal between the intake 14 and the inlet openings 50 when in the fully-closed position, allowing the livewell 22 to be used as a leak-free storage container. The valve switch 54 can also be rotated to any position between fully-closed and fully-open to control the flow of water into the livewell 22. As a result, while the pump 26 is operating, a user can control the flow of water into the livewell 22 (i.e., through the inlet openings 50) from zero flow to full flow using the fill valve 10 inside the livewell 22, rather than having to adjust the pump 26.

In addition, as shown in FIGS. 3 and 6, a conical end portion 66 of the valve switch 54 and the complimentary angled valve seat 62 can improve flow from the fill valve 10, as compared to conventional valves. In all positions except for the fully-closed position, the conical end portion 66 can protrude into the intake 14 so that the conical end portion 66 and the angled valve seat 62 permit an angled flow of fluid into the valve housing 12. As the valve switch 54 is rotated toward the fully-closed position, the valve seat 62 can receive the conical end portion 66 until the extension 58 contacts the valve seat 62 and substantially stops fluid communication between the intake 14 and the inlet openings 50.

In one embodiment, the valve switch 54 can be rotated by a user (e.g., using the adjustment knob 56) from the fully-closed position to the full-open position in about half of a full rotation. In some embodiments, the valve switch 54 can be constructed of Santoprene™ or a similar material.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A fill valve for use in a livewell having a wall, the fill valve comprising:

an intake;

a valve housing coupled to the intake, the valve housing including a front wall that is a rounded half-sphere, the front wall being coupled to a back wall that is substantially flat, the front wall including at least one inlet opening in fluid communication with the intake and a threaded cavity including an edge portion; and a threaded valve switch including an extension and accessible through the front wall and a conical end portion protruding into the intake and inwardly moveable against a flow out of the intake and outwardly moveable with a flow out of the intake, the valve switch rotatably positioned in the cavity and moveable into and out of the intake to switch between a first position allowing fluid communication between the at least one inlet opening and the intake and a second position, the first position comprising the extension of the valve switch being positioned outside of the intake and contacting the edge portion of the cavity forming a fully open position enabling fluid communication between the intake and the at least one inlet opening, and the second position comprising the extension being positioned inside the intake and contacting a valve seat of the intake forming a substantially liquid-tight seal between the at least one inlet opening and the intake and substantially disabling fluid communication between the intake and the at least one inlet opening.

2. The fill valve of claim 1 and further comprising a mounting nut for securing the valve housing against the wall of the livewell.

3. The fill valve of claim 2 wherein the intake includes a threaded portion and the mounting nut is rotatable about the threaded portion.

4. The fill valve of claim 1 and further comprising an adapter coupled to the intake via at least one of a press-fit and an adapter nut.

5. The fill valve of claim 4, wherein the adapter includes an approximately 90-degree bend.

6. The fill valve of claim 1 and further comprising an o-ring seal positioned adjacent to the back wall.

7. The fill valve of claim 1 wherein the back wall and the front wall are coupled together by screws.

8. The fill valve of claim 1 wherein the back wall and the intake are integrally coupled.

9. The fill valve of claim 1 wherein the intake includes a complementary angled valve seat to receive the conical end portion.

10. The fill valve of claim 1, wherein the valve switch is accessible from inside the livewell.

11. A fill valve for use in a livewell having a wall, the fill valve comprising:

a valve housing having a rounded half-sphere shape, the valve housing including a front wall and being configured and arranged to be coupled against the wall of the livewell and a threaded cavity comprising an edge portion, the cavity configured and arranged to house a rotatable valve switch through the front wall;

an intake coupled to the valve housing and configured and arranged to be positioned through the wall of the livewell, the intake including a threaded portion;

a valve switch rotatable positioned in the cavity and moveable into and out of the intake, the valve switch being threaded and including a conical end portion and an extension, the conical end portion protruding into the intake and inwardly moveable against a flow out of the intake and outwardly moveable with a flow out of the intake;

a mounting nut rotatable around the threaded portion to secure the valve housing against the wall of the livewell; and wherein the valve housing includes at least one inlet opening, the at least one inlet opening in fluid communication with the intake at least when the valve switch includes a fully open position comprising a coupling of the extension with the edge portion.

12. The fill valve of claim 11, wherein the rotatable valve switch is accessible through the front wall and rotatably positioned in the cavity to move into and out of the intake to switch between a first position allowing fluid communication between the at least one inlet opening and the intake and a second position, the first position comprising the extension of the valve switch being positioned outside of the intake and contacting the edge portion of the cavity forming a fully open position enabling fluid communication between the intake and the at least one inlet opening, and the second position comprising the extension being positioned inside the intake and contacting a valve seat of the intake forming a substantially liquid-tight seal between the at least one inlet opening and the intake and substantially disabling fluid communication between the intake and the at least one inlet opening.

13. The fill valve of claim 12 wherein the valve switch includes an o-ring pressed against a valve seat of the intake when the valve switch is positioned to provide a substantially liquid-tight seal between the at least one inlet opening and the intake.

14. The fill valve of claim 11 and further comprising an adapter removably coupled to the intake outside of the livewell.

15. A fill valve for a livewell having a wall and positioned on a boat, the boat having a pump, the fill valve comprising:

an intake positionable through a wall of the livewell;

an adapter removably couplable to the intake, the adapter orientable with respect to the intake; and a generally half-sphere shaped valve housing sphere, the valve housing being positioned against the wall of the livewell and coupled to the intake, the valve housing including a front wall with at least one inlet opening to permit fluid pumped by a pump to enter the livewell through the intake, the front wall including a threaded cavity comprising an edge portion, and a threaded valve switch accessible through the front wall to substantially prevent fluid pumped by the pump from entering the livewell through the intake, the valve switch including an extension and a concial end portion positioned within the intake and inwardly moveable against a flow out of the intake and outwardly moveable with a flow out of the intake;

the valve switch positioned in the intake to switch between a first position and a second position, the first position comprising the extension of the valve switch being positioned outside of the intake and contacting the edge portion of the cavity forming a fully open position enabling fluid communication between the intake and the at least one inlet opening, and the second position comprising the extension being positioned inside the intake and contacting a valve seat of the intake forming a substantially liquid-tight seal between the at least one inlet opening and the intake and substantially disabling fluid communication between the intake and the at least one inlet opening.

16. The fill valve of claim 15 wherein the adapter includes an approximately 90-degree bend.

17. The fill valve of claim 15 wherein the front wall is generally rounded and the valve housing includes a substantially flat back wall.

* * * * *